US009607544B2

(12) United States Patent
Lu et al.

(10) Patent No.: US 9,607,544 B2
(45) Date of Patent: Mar. 28, 2017

(54) BRIGHTNESS COMPENSATING METHOD AND SELF-ILLUMINATING DISPLAY DEVICE

(71) Applicants: Hisense Electric Co., Ltd., Qingdao (CN); HISENSE USA CORPORATION, Suwanee, GA (US); Hisense International Co., Ltd., Qingdao (CN)

(72) Inventors: Lin Lu, Qingdao (CN); Mingsheng Qiao, Qingdao (CN); Jianwei Cao, Qingdao (CN); Zhicheng Song, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 48 days.

(21) Appl. No.: 14/580,840

(22) Filed: Dec. 23, 2014

(65) Prior Publication Data

US 2016/0071487 A1 Mar. 10, 2016

(30) Foreign Application Priority Data

Sep. 5, 2014 (CN) ..... 2014 1 0452749

(51) Int. Cl.
*G09G 3/3208* (2016.01)

(52) U.S. Cl.
CPC ... *G09G 3/3208* (2013.01); *G09G 2320/0233* (2013.01); *G09G 2320/0285* (2013.01); *G09G 2320/041* (2013.01); *G09G 2320/043* (2013.01)

(58) Field of Classification Search
CPC ... G09G 2320/0233; G09G 2320/0285; G09G 2320/029; G09G 2320/0295; G09G 2320/043; G09G 2320/045
See application file for complete search history.

(56) References Cited

U.S. PATENT DOCUMENTS

2007/0080908 A1* 4/2007 Nathan ..... G09G 3/3241 345/77
2009/0115795 A1* 5/2009 Pae ..... G09G 3/3283 345/589

(Continued)

*Primary Examiner* — Viet Pham
(74) *Attorney, Agent, or Firm* — Harness, Dickey & Pierce, P.L.C.

(57) ABSTRACT

Embodiments of the application provide a brightness compensating method and a self-illuminating display device. The brightness compensating method includes: retrieving a table of compensation parameters pre-stored in the self-illuminating display device, which includes compensation parameters of the N zones, where a compensation parameter of a zone at higher temperature than the temperature in the reference zone is smaller than G, and a compensation parameter of a zone at lower temperature than the temperature in the reference zone is larger than G; and compensating for the brightness of an image displayed in each of the N zones according to the compensation parameters. The embodiments of the application can be applicable to compensation for the brightness of the self-illuminating display device.

10 Claims, 2 Drawing Sheets

(56) References Cited

U.S. PATENT DOCUMENTS

2013/0321361 A1* 12/2013 Lynch ..... H01L 27/3225
345/204
2014/0111567 A1* 4/2014 Nathan ..... G09G 3/3233
345/694

* cited by examiner

BRIGHTNESS COMPENSATING METHOD AND SELF-ILLUMINATING DISPLAY DEVICE

CROSS-REFERENCE TO RELATED APPLICATION

This application claims the benefit and priority of Chinese Patent Application No. 201410452749.X filed Sep. 5, 2014. The entire disclosure of the above application is incorporated herein by reference.

FIELD

The present application relates to the field of display elements and particularly to a brightness compensating method and a self-illuminating display device.

BACKGROUND

This section provides background information related to the present disclosure which is not necessarily prior art.

Along with the development of sciences and technologies, self-illuminating display elements have become increasingly widely applied due to their self-illuminating display capability, high response rate and other advantages, and in general, pixels of display screens of the self-illuminating display elements are constituted of Organic Light-Emitting Diodes (OLEDs) or other self-illuminating elements, but in the applications of the self-illuminating display elements, generally the phenomena of degradation and aging will occur with the self-illuminating elements which have served for a long period of time so that the phenomena of mura will arise in display by the self-illuminating display elements.

By way of an example, after an OLED display device has been used for a long period of time, the phenomena of degradation and aging will occur with self-illuminating elements of a display screen, the phenomena of degradation and aging of self-illuminating elements typically due to temperature or brightness thereof, where self-illuminating elements will be degraded and aged more quickly at higher operating temperature or self-illuminating elements will be degraded and aged more quickly at higher illumination brightness in operation. During operation of the OLED display device, the temperature in respective zones of the display screen thereof will rise differently over time, where generally the temperature in a central zone will rise significantly, and the temperature in a peripheral zone will rise insignificantly. Since the temperature in the respective zones rise differently, the self-illuminating elements in the respective zones of the display screen of the OLED display device will be degraded at different rates, that is, self-illuminating elements in a zone at significantly rising temperature will be degraded quickly, and self-illuminating elements in a zone at insignificantly rising temperature will be degraded slowly. After the OLED display device has been used for a long period of time, the difference between the rates at which the self-illuminating elements in the respective zones are degraded will become larger, so that the value of brightness in the zone, in the display screen of the OLED display device, where the self-illuminating elements are degraded quickly will become smaller, and the value of brightness in the zone where the self-illuminating elements are degraded slowly will become larger, thus resulting in poorer and poorer uniformity of brightness throughout the display screen of the OLED display device, as a consequence of which the phenomenon of blocky mura may arise.

SUMMARY

This section provides a general summary of the disclosure, and is not a comprehensive disclosure of its full scope or all of its features.

In an aspect, an embodiment of the application provides a brightness compensating method applicable to a self-illuminating display device, wherein a display screen of the self-illuminating display device includes N zones, which comprising a reference zone with a compensation parameter G, and N is an integer larger than or equal to 2, and the G is larger than 0, and the method includes:

retrieving compensation parameters of at least a part of the N zones, wherein a change trend of a compensation parameter of a zone at higher temperature than temperature in the reference zone relative to the compensation parameter G is opposite to a change trend of a compensation parameter of a zone at lower temperature than temperature in the reference zone relative to the compensation parameter G; and compensating for brightness of an image displayed in the respective zones according to the compensation parameters.

In another aspect, an embodiment of the application provides a self-illuminating display device, wherein a display screen of the self-illuminating display device includes N zones, which comprising a reference zone with a compensation parameter G, N is an integer larger than or equal to 2, and G is larger than 0; and the self-illuminating display device comprises a memory and one or more processors, and wherein the memory stores one or more computer readable program codes, and the one or more processors are configured to execute the one or more computer readable program codes to perform: retrieving compensation parameters of at least a part of the N zones, wherein a change trend of a compensation parameter of a zone at higher temperature than temperature in the reference zone relative to the compensation parameter G is opposite to a change trend of a compensation parameter of a zone at lower temperature than temperature in the reference zone relative to the compensation parameter G; and compensating for brightness of an image displayed in the respective zones according to the compensation parameters.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

BRIEF DESCRIPTION OF THE DRAWINGS

In order to make the technical solutions according to the embodiments of the application or in the prior art more apparent, the drawings to be used in a description of the embodiments or the prior art will be described below briefly, and apparently the drawings described below are only some of the embodiments of the application, and those ordinarily skilled in the art can further derive other drawings without any inventive effort from these drawings in which.

DETAILED DESCRIPTION

Example embodiments will now be described more fully with reference to the accompanying drawings.

The technical solutions according to the embodiments of the application will be described below clearly and fully with reference to the drawings in the embodiments of the application. Apparently the embodiments to be described are only a part not all of the embodiments of the application. Based upon the embodiments here of the application, all the other embodiments which can occur to those ordinarily skilled in the art without any inventive effort will fall into the scope of the application.

Figure 1:
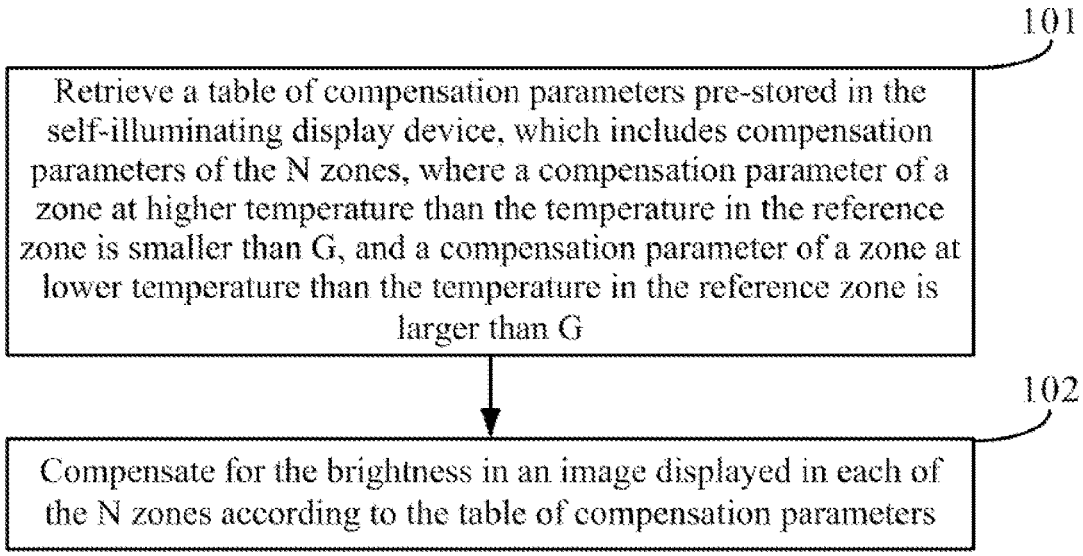
FIG. 1 is a flow chart of a method of determining a compensation parameter according to an embodiment of the application.

An embodiment of the application provides a brightness compensating method, as illustrated in FIG. 1, applicable to a self-illuminating display device which can be a plasma display device, an electro-wetting display device, an electrochromic display device, an OLED display device, etc., and the application will not be limited thereto although the embodiment of the application will be described taking an OLED display device as an example. A display screen of the self-illuminating display device is divided into N zones by their temperature gradients when the display screen is in stabilized operation, where the N zones include a reference zone with a compensation parameter G; N is an integer larger than or equal to 2, and G is larger than 0; and the stabilized operation refers to an operating state in which the operating temperature in the respective zones of the display screen are substantially stabilized, and the temperature gradients are a stepped profile of temperature throughout the respective zones of the display screen in operation and where the brightness compensating method includes the following operations:

The operation 101 is to retrieve a table of compensation parameters pre-stored in the self-illuminating display device, which includes compensation parameters of the N zones, where a compensation parameter of a zone at higher temperature than the temperature in the reference zone is smaller than G, and a compensation parameter of a zone at lower temperature than the temperature in the reference zone is larger than G.

Upon initialization, the table of compensation parameters is pre-stored in the self-illuminating display device, and the table of compensation parameters includes compensation parameters of the N zones, that is, the table of compensation parameters includes N compensation parameters, each of which corresponds to one of the zones. By way of an example, the table of compensation parameters can be stored in a control circuit of the self-illuminating display device or can be stored in a memory of the self-illuminating display device, and when an image is displayed on the display screen of self-illuminating display device, need only retrieve the pre-stored table of compensation parameters from the memory firstly.

In an embodiment of the application, for a zone at higher temperature than the temperature in the reference zone, a compensation parameter can be determined for the zone as a function of the temperature in the zone, but the compensation parameter of the zone must be smaller than G; and alike for a zone at lower temperature than the temperature in the reference zone, a compensation parameter can be determined for the zone as a function of the temperature in the zone, but the compensation parameter of the zone must be larger than G, the temperature in the zone can be the temperature in the zone at any time after the display screen is started into operation, and the embodiment of the application will not be limited thereto.

In an embodiment of the application, the temperature in the zone after the display screen is stabilized in operation can be utilized to thereby retrieve the compensation parameter of the zone more accurately, that is, after the display screen is stabilized in operation, the compensation parameter of the zone at higher temperature than the temperature in the reference zone is small than G, and the compensation parameter of the zone at lower temperature than the temperature in the reference zone is larger than G.

Moreover the table of compensation parameters mentioned here can exist otherwise instead of being pre-stored but can be generated as needed. Moreover the table of compensation parameters is only a way in which a data relationship between compensation parameters is embodied intuitively in some case, and the application will not be limited to any particular form in which it is embodied, for example, it can be embodied as a structure in a real data structure.

The operation 102 is to compensate for the brightness in an image displayed in each of the N zones according to the table of compensation parameters.

The image displayed on the display screen of the self-illuminating display device can be compensated for by compensating for the grayscale of each self-illuminating element in the display screen to compensate for the brightness of the image or by compensating for the gate drive voltage of each self-illuminating element in the display screen to compensate for the brightness of the image.

It shall be noted that when the brightness of the image is compensated for by compensating for the grayscale of each self-illuminating element, the grayscale can not become higher when the highest grayscale is displayed on the display screen, so the brightness at the self-illuminating element can not be raised by increasing the value of grayscale of the self-illuminating element, but generally the value of grayscale of the self-illuminating element can only be decreased to thereby lower the brightness of the image. When the brightness of the image is compensated for by increasing the value of gate drive voltage of each self-illuminating element, the brightness of the image can be raised by increasing the value of drive voltage of the self-illuminating element of the image, and also the brightness of the image can be lowered by decreasing the value of drive voltage of the self-illuminating element of the image.

As such, when the brightness is compensated for, the self-illuminating display device compensates for the brightness of the image displayed in each of the N zones according to the retrieved table of compensation parameters, in which different compensation parameters are set for different zones according to a temperature profile throughout the different zones of the display screen in operation so that there is lower brightness in a zone at higher temperature in the display screen and there is higher brightness in a zone at lower temperature in the display screen to thereby lower the rate, at which self-illuminating elements in the zone at higher operating temperature are degraded, by lowering the brightness in the zone at higher operating temperature.

Also the rate, at which self-illuminating elements in the zone at lower operating temperature are degraded is improved by raising the brightness in the zone at lower operating temperature, so that there is a smaller difference between the rate at which the self-illuminating elements in the zone at higher operating temperature are degraded and the rate at which the self-illuminating elements in the zone at lower operating temperature are degraded, thereby lowering the difference between the illumination brightness at the self-illuminating elements in the zone at higher operating temperature and the illumination brightness at the self-illuminating elements in the zone at lower operating temperature after operating for a long period of time so as to avoid the phenomenon of blocky mura occurring in the display screen of the self-illuminating display device after operating for a long period of time.

It shall be noted that firstly in order to ensure the display quality of the display screen, the display screen shipped from a factory typically satisfies preset uniformity of brightness, and subsequent to compensation by the compensation parameters, the uniformity of brightness in the display screen after compensation may not satisfy the preset uniformity of brightness, and at this time the current display quality of the display screen may be deteriorated despite a lower difference between the rate at which self-illuminating elements in a zone at higher operating temperature are degraded and the rate at which self-illuminating elements in a zone at lower operating temperature are degraded. Thus in a practical application, the compensation parameters of the table of compensation parameters can be set while satisfying the uniformity of brightness so that the difference between the rate at which self-illuminating elements in a zone at higher operating temperature are degraded and the rate at which self-illuminating elements in a zone at lower operating temperature are degraded can be lowered as much as possible while the display screen satisfies the uniformity of brightness.

Secondly the display screen is divided into the N zones by the temperature profile of the display screen. Generally after the self-illuminating display device has been used for a period of time, there is a stepped profile of temperature throughout the respective zones of the display screen, and the display screen can be divided in the N zones according to the temperature profile of the display screen, where N is any integer larger or equal to 2, and the embodiment of the application will not be limited thereto.

By way of an example, after the display screen has been used for a period of time, there is higher temperature in a central zone, and there is lower temperature in peripheral zones, so the display screen can be divided into the central zone and the peripheral zones, and the peripheral zones can be further divided into several sub-zones according to temperature gradients in the peripheral zones, and the embodiment of the application will not be limited to any particular division. The display screen can be divided into the zones according to the temperature profile thereof to thereby compensate for the brightness in the respective zones accordingly. By way of an example, after the display screen has been used for a period of time, self-illuminating display elements in a zone at temperature above 50° C. in the display screen can be allocated to the central zone, and the other self-illuminating display elements outside the central zone of the display screen can be allocated to the peripheral zones, and then the peripheral zones can be further divided according to their temperature gradients.

In an embodiment of the application, the table of compensation parameters can be a first table of compensation parameters or a second table of compensation parameters, where when the table of compensation parameters is the first table of compensation parameters, one of the N zones at the highest temperature is the reference zone, and the compensation parameter of the zone at the highest temperature in the first table of compensation parameters is G, all of the compensation parameters of the other N−1 zones are larger than G, and the largest one of the N compensation parameters is smaller than or equal to A which is the ratio of the value of brightness in the brightest one to the value of brightness in the darkest one of the N zones when a fully white image is displayed by the self-illuminating display device; and When the table of compensation parameters is the second table of compensation parameters, one of the N zones at the lowest temperature is the reference zone, and the compensation parameter of the zone at the lowest temperature in the second table of compensation parameters is G, all of the compensation parameters of the other N−1 zones is smaller than G, and the smallest one of the N compensation parameters is larger than or equal to B which is the ratio of the value of brightness in the darkest one to the value of brightness in the brightest one of the N zones when a fully white image is displayed by the self-illuminating display device.

It shall be noted that the value of brightness in each zone can be the brightness at the central point in each zone, that is, the value of brightness at the central point in the zone can be taken as the value of brightness throughout the zone.

When the image displayed on the display screen of the self-illuminating display device is compensated for according to the first table of compensation parameters, the brightness of the image in the respective zones can be raised or maintained by setting the compensation parameters larger than or equal to G respectively for the respective zones of the image. In an embodiment of the application, the compensation parameter of the zone at the highest temperature can be set to and then the compensation parameters can be set for the other N−1 zones as a function of higher or lower temperature in the other N−1 zones after the self-illuminating display device has operated for a preset period of time.

In an embodiment of the application, firstly the differences in temperature between the other N−1 zones and the zone at the highest temperature after the self-illuminating display device has operated for the preset period of time can be determined, and then the compensation parameters can be set for the other N−1 zones according to the differences in temperature between the other N−1 zones and the zone at the highest temperature, so that the compensation parameters of the other N−1 zones are incremented sequentially in a first order which is an order of descending temperature in which the other N−1 zones are arranged, that is, the compensation parameters of the other N−1 zones are incremented sequentially in an order of ascending differences in temperature between the other N−1 zones and the zone at the highest temperature, so that a compensation parameter of a zone at lower temperature is larger than a compensation parameter of a zone at higher temperature, that is, a compensation parameters of a zone with a larger difference in temperature is larger than a compensation parameter of a zone with a smaller difference in temperature, thereby increasing the rate at which self-illuminating display devices in the zone at lower temperature are degraded and maintaining the rate at which self-illuminating display devices in the zone at higher temperature are degraded so as to make degrading of the self-illuminating display devices in the respective zones of the image become substantially uniform.

Moreover when the largest one of the N compensation parameters is smaller than or equal to A, the difference between the rate at which the self-illuminating display devices in the zone at higher operating temperature are degraded and the rate at which the self-illuminating display devices in the zone at lower operating temperature are degraded can be lowered as much as possible while ensuring the uniformity of brightness throughout the display screen after compensation so that the display screen satisfies the uniformity of brightness.

When the image displayed on the display screen is compensated for according to the second table of compensation parameters, the brightness of the image in the respective zones can be lowered or maintained by multiplying the compensation parameters of the respective zones of the image respectively by a coefficient smaller than or equal to G. In an embodiment of the application, the compensation parameter of the zone at the lowest temperature can be set to and then the compensation parameters can be set for the other N−1 zones as a function of higher or lower temperature in the other N−1 zones after the self-illuminating display device has operated for a preset period of time.

In an embodiment of the application, firstly the differences in temperature between the other N−1 zones and the zone at the lowest temperature after the self-illuminating display device has operated for the preset period of time can be retrieved, and then the compensation parameters can be set for the other N−1 zones according to the differences in temperature between the other N−1 zones and the zone at the lowest temperature, so that the compensation parameters of the other N−1 zones are decremented sequentially in a second order which is an order of ascending temperature in which the other N−1 zones are arranged, that is, the compensation parameters of the other N−1 zones are decremented sequentially in an order of ascending differences in temperature between the other N−1 zones and the zone at the lowest temperature, so that a compensation parameter of a zone at higher temperature is smaller than a compensation parameter of a zone at lower temperature.

That is, a compensation parameters of a zone with a larger difference in temperature is smaller than a compensation parameter of a zone with a smaller difference in temperature, thereby decreasing the rate at which self-illuminating display devices in the zone at higher temperature are degraded and maintaining the rate at which self-illuminating display devices in the zone at lower temperature are degraded so as to make degrading of the self-illuminating display devices in the respective zones of the image become substantially uniform, and since the lowest one of the N compensation parameters is larger than or equal to B, the difference between the rate at which the self-illuminating display devices in the zone at higher operating temperature are degraded and the rate at which the self-illuminating display devices in the zone at lower operating temperature are degraded can be lowered as much as possible while ensuring the uniformity of brightness throughout the display screen after compensation so that the display screen satisfies the uniformity of brightness.

Furthermore before the table of compensation parameters pre-stored in the self-illuminating display device is retrieved, the self-illuminating display device further needs to input an all-white image on the display screen of the self-illuminating display device and to obtain the original brightness in each of the N zones; to derive A from the value of brightness in each of the N zones or to derive B from the value of brightness in each of the N zones; to obtain the temperature in each of the N zones after the self-illuminating display device has operated for a preset period of time; to create the first table of compensation parameters from the temperature in each of the N zones, and G and A or to create the second table of compensation parameters from the temperature in of each of the N zone and G and B; and to store the first table of compensation parameters or the second table of compensation parameters.

By way of an example, the all-white image generally refers to an image in which the same grayscale is displayed at all the self-illuminating elements, and the all-white image in an example of the embodiment of the application is an image in which all of the grayscales displayed at all the self-illuminating elements are the grayscale 255. In an embodiment of the application, after the all-white image at the grayscale 255 is input on the display screen of the self-illuminating display device, the values of brightness are obtained, and then the largest one and the smallest one of the values of brightness in the N respective zones are determined, where A is the ratio of the largest value of brightness to the smallest value of brightness, and B is the ratio of the smallest value of brightness to the largest value of brightness, and A and B are reciprocals of each other.

Then after the self-illuminating display device has operated for a preset period of time, the temperature in each of the N zones is obtained, the preset period of time is predetermined, and generally there is uniform temperature in the respective zones of the display screen upon initialization, the temperature in the respective zones on the display screen will be raised differently after it is started into operation, and the temperature in the respective zones of the display screen will become substantially stabilized after it has operated for one hour, so the preset period of time can be set to one hour in a possible instance. By way of an example, the temperature in each of the N zones is obtained by a temperature detector after one hour, and the difference between the temperature in each of the N zones after the display screen has operated for one hour and the temperature in the respective zone upon initialization is referred to as a rise in temperature in that zone.

By way of an example, when the first table of compensation parameters is created from the temperature in each of the N zones, G and A; or the second table of compensation parameters is created from the temperature in each of the N zones, G and B, G can be any number larger than 0, and the embodiment of the application will be described taking G=1 as an example.

For example, the first table of compensation parameters can be created by setting the compensation parameter of one of the N zones at the highest temperature to 1 and then setting the compensation parameters for the other N−1 zones according to the differences in temperature between the other N−1 zones and the zone at the highest temperature after the self-illuminating display device has operated for a preset period of time, so that the compensation parameters of the other N−1 zones are incremented sequentially in a first order which is an order of descending temperature in which the other N−1 zones are arranged, that is, the compensation parameters of the other N−1 zones are incremented sequentially in an order of ascending differences in temperature between the other N−1 zones and the zone at the highest temperature, so that a compensation parameter of a zone at lower temperature is larger than a compensation parameter of a zone at higher temperature, that is, a compensation parameters of a zone with a larger difference in temperature is larger than a compensation parameter of a zone with a smaller difference in temperature.

The second table of compensation parameters can be created by setting the compensation parameter of the zone at the lowest temperature to 1 and then setting the compensation parameters for the other N−1 zones according to the differences in temperature between the other N−1 zones and the zone at the lowest temperature after the self-illuminating display device has operated for a preset period of time, so that the compensation parameters of the other N−1 zones are decremented sequentially in a second order which is an order of ascending temperature in which the other N−1 zones are arranged, that is, the compensation parameters of the other N−1 zones are decremented sequentially in an order of ascending differences in temperature between the other N−1 zones and the zone at the lowest temperature, so that a compensation parameter of a zone at higher temperature is smaller than a compensation parameter of a zone at lower temperature, that is, a compensation parameters of a zone with a larger difference in temperature is smaller than a compensation parameter of a zone with a smaller difference in temperature.

After the first table of compensation parameters or the second table of compensation parameters is created, the first table of compensation parameters or the second table of compensation parameters is stored in the self-illuminating display device. Thus when the self-illuminating display device is operating, the first table of compensation parameters or the second table of compensation parameters stored in the self-illuminating display device can be retrieved simply for corresponding compensation.

In an embodiment of the application, alternatively the temperature in each of the N zones after a plurality of different preset periods of time can be obtained respectively. By way of an example, the temperature in each of the N zones after ten minutes, twenty minutes, thirty minutes, forty minutes, fifty minutes and one hour can be obtained respectively.

For example, after the self-illuminating display device has operated for ten minutes, the temperature in each of the N zones is obtained by a temperature detector, and then the corresponding first table of compensation parameters or second table of compensation parameters of the self-illuminating display device when the preset period of time is ten minutes is created from the temperature in each of the N zones. After the self-illuminating display device has operated for twenty minutes, the temperature in each zone will be raised differently, and the temperature in each of the N zones can be obtained by the temperature detector, and alike the corresponding first table of compensation parameters or second table of compensation parameters of the self-illuminating display device when the preset period of time is twenty minutes can be created through the same calculation, and so on until six first tables of compensation parameters or second tables of compensation parameters are created after the self-illuminating display device has operated for one hour, and all of the six first tables of compensation parameters or second tables of compensation parameters are stored in the self-illuminating display device.

The image displayed on the display screen of the self-illuminating display device can be compensated for by retrieving for a different period of time the first table of compensation parameters or the second table of compensation parameters corresponding to the period to compensate for the brightness of the image.

For example, when the self-illuminating display device has operated for more than ten minutes and less than twenty minutes, the image displayed on the display screen of the self-illuminating display device is compensated by retrieving the corresponding first table of compensation parameters or second table of compensation parameters of the self-illuminating display device when the preset period of time is ten minutes; when the self-illuminating display device has operated for more than twenty minutes and less than thirty minutes, the image displayed on the display screen of the self-illuminating display device is compensated by retrieving the corresponding first table of compensation parameters or second table of compensation parameters of the self-illuminating display device when the preset period of time is twenty minutes, and so on until when the self-illuminating display device has operated for one hour or more, after the temperature of the self-illuminating display device becomes substantially stabilized, the image displayed on the display screen can be compensated by retrieving the corresponding first table of compensation parameters or second table of compensation parameters of the self-illuminating display device when the preset period of time is one hour.

With such progressive compensation, when the self-illuminating display device compensates for the displayed image according to the first table of compensation parameters, it will not be necessary to raise at the beginning the brightness at self-illuminating elements in a zone at lower temperature after the display device has operated for one hour, so the lifetime of the self-illuminating display device can be prolonged while lowering the rates at which self-illuminating elements in a zone at higher temperature and the self-illuminating elements in the zone at lower temperature are degraded; and when the self-illuminating display device compensates for the displayed image according to the second table of compensation parameters, it will not be necessary to lower at the beginning the brightness at self-illuminating elements in a zone at higher temperature after the display device has operated for one hour, so the display quality of the display device after the display device has operated for less than one hour can be ensured while lowering the rates at which the self-illuminating elements in the zone at the higher temperature and self-illuminating elements in a zone at lower temperature are degraded.

Furthermore when the first table of compensation parameters is created from the temperature in each of the N zones, G and A, the compensation parameter of the zone at the highest temperature is determined G, and then the compensation parameter $k_i$ of the i-th zone among the other N−1 zones can be derived in Equation (1) of $$k_i = G + \frac{D_i|G - A|}{S},$$

where $D_i$ represents the difference in temperature between the i-th zone and the zone at the highest temperature, S represents the rise in temperature of the zone at the highest temperature, $1 \le i \le (N-1)$, and the rise in temperature of the zone at the highest temperature is the difference between the temperature in the zone at the highest temperature after operating for the preset period of time and the temperature thereof before being started into operation. Furthermore the first table of compensation parameters can be created from the compensation parameter G of the zone at the highest temperature and the compensation parameters of the other N−1 zones.

Where Equation (1) is derived particularly as follows: A is determined, where A is larger than 1; the difference between the compensation parameter G of the zone at the highest temperature and A is divided into P segments by a step of Q, where $$Q = \frac{|G - A|}{P};$$

the differences in temperature between the other (N−1) zones and the zone at the highest temperature are obtained, where the difference in temperature in the i-th zone among the (N−1) zones is $D_i$ with $1 \le i \le (N-1)$; and the compensation parameter $k_i$ of the i-th zone is derived in Equation of $$k_i = G + \left(D_i \Big/ \left(\frac{S}{P}\right)\right) \times Q = G + \frac{D_i \times P}{S} \times \frac{|G-A|}{P} = G + \frac{D_i \times |G-A|}{S}.$$

It shall be noted that the difference in temperature is the difference in temperature rise.

Figure 2:
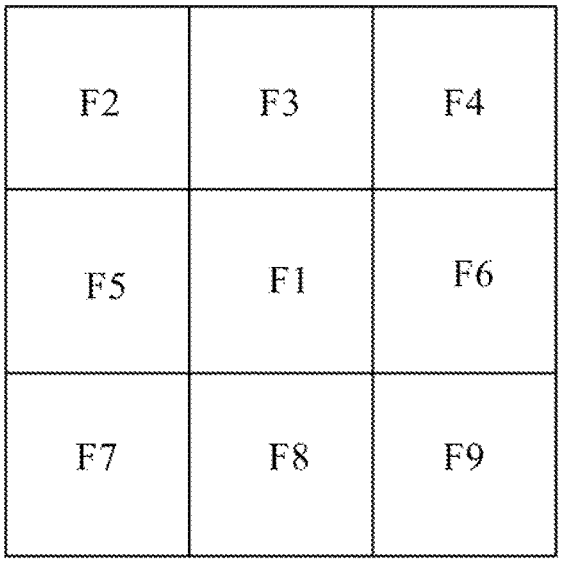
FIG. 2 is a schematic diagram of the division of a self-illuminating display device into zones according to an embodiment of the application.

By way of an example, as illustrated in FIG. 2, the OLED display device is divided into nine zones, which are F1, F2, F3, F4, F5, F6, F7, F8 and F9 respectively, according to the temperature profile thereof.

Generally after the self-illuminating display device has operated for a period of time, there is a gradient profile of temperature thereof with higher temperature in a central zone and lower temperature in peripheral zones, and the display screen of the self-illuminating display device is divided into the zones according to the temperature profile thereof by allocating self-illuminating elements at the same gradient of temperature to the same zone and self-illuminating elements at different gradients of temperature to different zones.

It is assumed that the original values of brightness in these nine zones are obtained as depicted in Table 1.

TABLE 1

| | | |
|---|---|---|
| 80 | 83 | 87 |
| 90 | 100 | 94 |
| 85 | 93 | 95 |

As can be apparent from Table 1, the brightest one of the nine zones is the zone F1 at the value 100 of brightness, and the darkest of the nine zones is the zone F2 at the value 80 of brightness, so that A=100/80=1.25. From Table 1, the uniformity of brightness of the OLED display device can be further derived as H=80/100=80%.

It is assumed that the temperature in these nine zones is obtained after one hour, and further the values of rises in temperature in the nine zones are derived as depicted in Table 2.

TABLE 2

| | | |
|---|---|---|
| 1° | 2° | 2° |
| 5° | 10° | 6° |
| 7° | 6° | 8° |

As can be apparent from Table 2, one of the nine zones at the largest rise in temperature is the zone F1, that is, the temperature in the zone F1 is the highest, so the zone F1 is the zone at the highest temperature with a rise 10° in temperature. Then the differences in temperature between the other eight zones and the zone at the highest temperature are calculated, and the difference in temperature in the i-th zone among the eight zones is $D_i$ with $1 \le i \le (N-1)$, so the values of differences in temperature between the respective zones and the zone at the highest temperature are as depicted in Table 3.

TABLE 3

| | | |
|---|---|---|
| 9° | 8° | 8° |
| 5° | 0° | 4° |
| 3° | 4° | 2° |

In connection with Table 3, the compensation parameter $k_i$ of the i-th zone can be calculated in Equation (1), where S represents the value 10° of rise in temperature in the zone at the highest temperature, A is 1.25, and $D_i$ represents the value of difference in temperature in the i-th zone.

Taking G=1 as an example for a description, the compensation parameter of the zone at the highest temperature and the compensation parameters of the other eight zones are derived as depicted in Table 4.

TABLE 4

| | | |
|---|---|---|
| 1.225 | 1.2 | 1.2 |
| 1.125 | 1 | 1.1 |
| 1.075 | 1.1 | 1.05 |

As can be apparent from the data in Table 2 and Table 4, among the other eight zones, there is a smaller compensation parameter of a zone at higher temperature, and there is a larger compensation parameter of a zone at lower temperature, that is, there is a larger compensation parameter of a zone with a smaller rise in temperature, and there is a smaller compensation parameter of a zone with a larger rise in temperature, that is, the compensation parameters of these eight zones are incremented sequentially in a first order which is an order of descending temperature in which the other N−1 zones are arranged because a zone with a smaller rise in temperature is multiplied by a larger compensation parameter to thereby raise the brightness in the zone so as to increase the rate at which self-illuminating elements in the zone are degraded, and a zone with a larger rise in temperature is multiplied by a smaller compensation parameter to thereby maintain the rate at which self-illuminating elements in the zone are degraded, thus making the self-illuminating elements in the respective zones of the image become substantially uniform.

By way of an example, the rise in temperature in the zone at the lowest temperature is 1°, and the rise in temperature in the zone at the highest temperature is 10°, so the rise in temperature in the zone at the lowest temperature is smaller than the rise in temperature in the zone at the highest temperature, and when the self-illuminating display device does not compensate for brightness, the rate at which the self-illuminating elements in the zone at the highest temperature are degraded will be higher than the rate at which the self-illuminating elements in the zone at the lowest temperature are degraded. The compensation parameter of the zone at the lowest temperature calculated in the brightness compensating method is 1.225, and the calculated compensation parameter of the zone at the highest temperature is 1, so the compensation parameter of the zone at the lowest temperature is larger than the compensation parameter of the zone at the highest temperature. Thus after brightness is compensated for, the rate at which the self-illuminating elements in the zone at the lowest temperature are degraded is increased, and the rate at which the self-illuminating elements in the zone at the highest temperature are degraded is maintained, so that there is a smaller difference in degradation between the self-illuminating elements in the zone at the highest temperature and the self-illuminating elements in the zone at the lowest temperature.

Then the original brightness in the respective zones in Table 1 is compensated for according to the compensation parameters of Table 4 so that the values of brightness in the respective zones after compensation can be obtained as depicted in Table 5.

TABLE 5

| | | |
|---|---|---|
| 98 | 99.6 | 104.4 |
| 101.25 | 100 | 103.4 |
| 91.375 | 102.3 | 99.75 |

As can be apparent from Table 5, there is no change in value of brightness in the zone with the largest rise in temperature, there is a significant increase in value of brightness in the zone with the smallest rise in temperature, and also there are corresponding adjustments in the remaining zones as a function of the quantities of their rises in temperature. Additionally the uniformity of brightness of the OLED display device after compensation can be derived from Table 5 as H=91.375/104.4≈87.5% suggesting a significant improvement in uniformity of brightness over previous 80%. In general, after brightness is compensated for, one on hand, the uniformity of brightness of the display screen can be improved, and on the other hand, the rates at which the self-illuminating elements in the respective zones are degraded can become substantially uniform, thus addressing the phenomenon of blocky mura occurring in the OLED display device after operating for a long period of time.

Furthermore when the second table of compensation parameters is created from the temperature in each of the N zones, G and B, the compensation parameter of the zone at the lowest temperature is determined as G, and then the compensation parameter $k_i$ of the i-th zone among the other N−1 zones can be derived in Equation (2) of $$k_i = G - \frac{D_i|G-B|}{S},$$

where $D_i$ represents the difference in temperature between the i-th zone and the zone at the lowest temperature, S represents the rise in temperature of the zone at the highest temperature, $1 \le i \le (N-1)$, and the rise in temperature of the zone at the highest temperature is the difference between the temperature in the zone at the highest temperature after operating for the preset period of time and the temperature thereof before being started into operation. Furthermore the second table of compensation parameters can be created from the compensation parameter G of the zone at the lowest temperature and the compensation parameters of the other N−1 zones.

Where Equation (2) is derived particularly as follows: B is determined, where B is smaller than 1; the difference between the compensation parameter G of the zone at the lowest temperature and B is divided into W segments by a step of E, where $$E = \frac{|G-B|}{W};$$

the differences in temperature between the other (N−1) zones and the zone at the lowest temperature are obtained, where the difference in temperature in the i-th zone among the (N−1) zones is $D_i$ with $1 \le i \le (N-1)$; and the compensation parameter $k_i$ of the i-th zone is derived in Equation of $$k_i = G - \left(D_i \Big/ \left(\frac{S}{W}\right)\right) \times E = G - \frac{D_i \times W}{S} \times \frac{|G-B|}{W} = G - \frac{D_i \times |G-B|}{S}.$$

By way of an example, as illustrated in FIG. 2, it is assumed that the original values of brightness in these nine zones are still as depicted in Table 1. As can be apparent from Table 1, the brightest one of the nine zones is the zone F1 at the value 100 of brightness, and the darkest of the nine zones is the zone F2 at the value 80 of brightness, so that B=80/100=0.8. From Table 1, the uniformity of brightness of the OLED display device at this time can be derived still as H=80/100=80%.

It is assumed that the temperature in these nine zones is obtained after one hour, and further the values of rises in temperature in the nine zones are derived still as depicted in Table 2. As can be apparent from Table 2, one of the nine zones at the smallest rise in temperature is the zone F2, so the zone F2 is the zone at the lowest temperature with a rise 1° in temperature. Then the differences in temperature between the other eight zones and the zone at the lowest temperature can be derived from Table 2 as $D_i$, particular values of which are as depicted in Table 6.

TABLE 6

| | | |
|---|---|---|
| 0° | 1° | 1° |
| 4° | 9° | 5° |
| 6° | 5° | 7° |

In connection with Table 6, the compensation parameter $k_i$ of the i-th zone can be calculated in Equation (2), where S represents the value 10° of rise in temperature in the zone at the highest temperature, B is 0.8, and $D_i$ represents the value of difference in temperature in the i-th zone.

Taking G=1 as an example for a description, the compensation parameter of the zone at the lowest temperature and the compensation parameters of the other eight zones are derived as depicted in Table 7.

TABLE 7

| | | |
|---|---|---|
| 1 | 0.98 | 0.98 |
| 0.92 | 0.82 | 0.9 |
| 0.88 | 0.9 | 0.86 |

As can be apparent from the data in Table 2 and Table 7, among the other eight zones, there is a larger compensation parameter of a zone at lower temperature, and there s a smaller compensation parameter of a zone at higher temperature, that is, there is a larger compensation parameter of a zone with a smaller rise in temperature, and there is a smaller compensation parameter of a zone with a larger rise in temperature, that is, the compensation parameters of these eight zones are decremented sequentially in a second order which is an order of ascending temperature in which the other N−1 zones are arranged because a zone with a smaller rise in temperature is multiplied by a larger compensation parameter to thereby maintain the brightness in the zone, and maintain the rate at which self-illuminating elements in the zone are degraded, and a zone with a larger rise in temperature is multiplied by a smaller compensation parameter to thereby lower the brightness in the zone so as to decrease the rate at which self-illuminating elements in the zone are degraded, thus making the self-illuminating elements in the respective zones of the image become substantially uniform.

By way of an example, the rise in temperature in the zone at the lowest temperature is 1°, and the rise in temperature in the zone at the highest temperature is 10°, so the rise in temperature in the zone at the lowest temperature is smaller than the rise in temperature in the zone at the highest temperature, and when the self-illuminating display device does not compensate for brightness, the rate at which the self-illuminating elements in the zone at the highest temperature are degraded will be higher than the rate at which the self-illuminating elements in the zone at the lowest temperature are degraded. The compensation parameter of the zone at the lowest temperature calculated in the brightness compensating method is 1, and the calculated compensation parameter of the zone at the highest temperature is 0.82, so the compensation parameter of the zone at the highest temperature is larger than the compensation parameter of the zone at the lowest temperature. Thus after brightness is compensated for, the rate at which the self-illuminating elements in the zone at the highest temperature are degraded is decreased, and the rate at which the self-illuminating elements in the zone at the lowest temperature are degraded is maintained, so that there is a smaller difference in degradation between the self-illuminating elements in the zone at the highest temperature and the self-illuminating elements in the zone at the lowest temperature.

Then the original brightness in the respective zones in Table 1 is compensated for according to the compensation parameters of Table 7 so that the values of brightness in the respective zones after compensation can be obtained as depicted in Table 8.

TABLE 8

| | | |
|---|---|---|
| 80 | 81.34 | 85.26 |
| 82.8 | 82 | 84.6 |
| 74.8 | 83.7 | 81.7 |

As can be apparent from Table 8, there is no change in value of brightness in the zone with the smallest rise in temperature, there is a significant decrease in value of brightness in the zone with the largest rise in temperature, and also there are corresponding adjustments in the remaining zones as a function of the quantities of their rises in temperature, thereby postponing aging in brightness of self-illuminating elements in a zone with a larger rise in temperature and prolonging the lifetime of the self-illuminating display device. Moreover the uniformity of brightness of the OLED display device after compensation can be derived from Table 8 as H=74.8/85.26≈87.7% suggesting a significant improvement in uniformity of brightness over previous 80%. In general, after brightness is compensated for, one on hand, the uniformity of brightness of the display screen can be improved, and on the other hand, the rates at which the self-illuminating elements in the respective zones are degraded can become substantially uniform, and the lifetimes of the self-illuminating elements in the respective zones can be prolonged differently, thus addressing the phenomenon of blocky mura occurring in the OLED display device after operating for a long period of time.

Furthermore after the first table of compensation parameters is created from the temperature in each of the N zones, G and A or the second table of compensation parameters is created from the temperature in each of the N zones, G and B, the brightness compensating method can further includes the following operations:

The all-white image is compensated for according to the first table of compensation parameters or the second table of compensation parameters; the brightness after compensation in each of the N zones after compensation is obtained; the uniformity of brightness of the display screen after compensation is derived from the brightness after compensation in each of the N zones; and if the uniformity of brightness of the display screen after compensation is lower than preset uniformity of brightness, then the compensation parameters, in the first table of compensation parameters, corresponding to the respective zones with values of brightness larger than a first value of brightness among the N zones after compensation are revised as a function of the preset uniformity of brightness and the value of brightness in the darkest one of the N zones after compensation to create a first table of revised compensation parameters, or the compensation parameters, in the second table of compensation parameters, corresponding to the respective zones with values of brightness larger than a second value of brightness among the N zones after compensation are revised as function thereof to create a second table of revised compensation parameters, where the first value of brightness is the ratio of the value of brightness in the darkest one of the N zone to the preset uniformity of brightness; and the first table of revised compensation parameters or the second table of revised compensation parameters is stored.

The brightness of the image displayed in each of the N zones can be compensated as function of the table of compensation parameters by compensating for the brightness of the image displayed in each of the N zones on the display screen of the self-illuminating display device according to the first table of revised compensation parameters or the second table of revised compensation parameters.

It shall be noted that after the all-white image is compensated for according to the first table of compensation parameters or the second table of compensation parameters, the uniformity of the display screen after compensation may be lower than the preset uniformity of brightness, thus degrading a display effect on the display screen, and when the uniformity of brightness of the display screen after compensation is lower than the preset uniformity of brightness, the first table of revised compensation parameters or the second table of revised compensation parameters needs to be adjusted. It shall be adjusted to make as much as possible the rates at which the self-illuminating elements are degraded become substantially uniform while ensuring the uniformity of brightness.

By way of an example, as illustrated in FIG. 2, the OLED display device is still divided into nine zones, which are F1, F2, F3, F4, F5, F6, F7, F8 and F9 respectively, according to the temperature profile thereof. It is assumed that the original values of brightness in these nine zones are obtained as depicted in Table 9.

TABLE 9

| | | |
|---|---|---|
| 80 | 83 | 98 |
| 90 | 100 | 94 |
| 85 | 93 | 95 |

As can be apparent from Table 9, the brightest one of the nine zones is the zone F1 at the value 100 of brightness, and the darkest one of the nine zones is at the value 80 of brightness, so that A=100/80=1.25. From Table 9, the uniformity of brightness of the OLED display device can be further derived as H=80/100=80% which can be taken as the preset uniformity of brightness, where the uniformity of brightness is the ratio of the smallest value of brightness to the largest value of brightness in the display device. In a practical application, alternatively the preset uniformity of brightness can be set for the self-illuminating display device dependent upon a particular condition, and the embodiment of the application will not be limited thereto.

It is assumed that the rises in temperature in these nine zones are obtained after one hour as depicted in Table 10.

TABLE 10

| | | |
|---|---|---|
| 1° | 2° | 1° |
| 5° | 10° | 6° |
| 7° | 6° | 8° |

In connection Table 10, the compensation parameter of each zone can be derived in Equation of $$k_i = G + \frac{D_i|G - A|}{S},$$

where G=1, as depicted in Table 11.

TABLE 11

| | | |
|---|---|---|
| 1.225 | 1.2 | 1.225 |
| 1.125 | 1 | 1.1 |
| 1.075 | 1.1 | 1.05 |

Then the original brightness in the respective zones in Table 9 is compensated for according to the compensation parameters of Table 11 so that the values of brightness in the respective zones after compensation can be obtained as depicted in Table 12.

TABLE 12

| | | |
|---|---|---|
| 98 | 99.6 | 120.05 |
| 101.25 | 100 | 103.4 |
| 91.375 | 102.3 | 99.75 |

The uniformity of brightness of the OLED display device after compensation can be derived from Table 12 as H=91.375/120.05≈76.1%, and as compared with the preset compensation is lower than the preset uniformity of brightness, and at this time the first table of compensation parameters needs to be adjusted. Firstly a first value L of brightness is calculated, and if the first value L of brightness is the ratio of the value of brightness in the darkest one of the nine zones to the preset uniformity of brightness, then the first value L of brightness can be derived as L=91.375/0.8≈114.219. Then the value of brightness in each zone in Table 12 is compared with the first value L of brightness, and for a zone with a value of brightness larger than the first value L of brightness, the first value L of brightness is assigned to the zone, so the revised values of brightness after compensation can be derived as depicted in Table 13.

TABLE 13

| | | |
|---|---|---|
| 98 | 99.6 | 114.219 |
| 101.25 | 100 | 103.4 |
| 91.375 | 102.3 | 99.75 |

In connection with both Table 9 and Table 13, the first table of compensation tables after revision can be derived inversely as the first table of revised compensation tables as depicted in Table 14.

TABLE 14

| | | |
|---|---|---|
| 1.225 | 1.2 | 1.1655 |
| 1.125 | 1 | 1.1 |
| 1.075 | 1.1 | 1.05 |

Then the first table of revised compensation tables depicted in Table 14 can be stored in the self-illuminating display device, and then the image displayed on the display screen of the self-illuminating display device can be compensated for according to the first table of revised compensation tables.

As can be apparent from comparison of Table 11 with Table 14, the compensation parameter of the zone F4 can be revised to thereby ensure the uniformity of brightness of the OLED display device not to be lower than the preset uniformity of brightness, so that the image displayed on the display screen can be compensated for according to the first table of revised compensation tables to thereby lower the difference in degradation of the self-illuminating elements in the respective zones as much as possible while ensuring the uniformity of brightness.

Alike the second table of revised compensation parameters can be derived as follows:

As illustrated in FIG. 2, the OLED display device is still divided into nine zones, which are F1, F2, F3, F4, F5, F6, F7, F8 and F9 respectively, according to the temperature profile thereof, and the original values of brightness in these nine zones are obtained as depicted in Table 9, the preset uniformity of brightness is still 80%, and the rises in temperature after one hour are still as depicted in Table 10; and the compensation parameter of each zone can be calculated in Equation of $$k_i = G - \frac{D_i|G - B|}{S}$$

as depicted in Table 15.

TABLE 15

| | | |
|---|---|---|
| 1 | 0.98 | 1 |
| 0.92 | 0.82 | 0.9 |
| 0.88 | 0.9 | 0.86 |

Then the original brightness in the respective zones in Table 9 is compensated for according to the compensation parameters of Table 15 so that the values of brightness in the respective zones after compensation can be obtained as depicted in Table 16.

TABLE 16

| | | |
|---|---|---|
| 80 | 81.34 | 98 |
| 82.8 | 82 | 84.6 |
| 74.8 | 83.7 | 81.7 |

The uniformity of brightness of the OLED display device after compensation can be derived from Table 16 as H=74.8/98≈76.33%, and as compared with the preset uniformity 80% of brightness, the uniformity of brightness of the display screen after compensation is lower than the preset uniformity of brightness, and at this time the second table of compensation parameters needs to be adjusted. Firstly a first value L of brightness is calculated, and if the first value L of brightness is the ratio of the value of brightness in the darkest one of the nine zones to the preset uniformity of brightness, then the first value L of brightness can be derived as L=74.8/0.8=93.5. Then the value of brightness in each zone in Table 16 is compared with the first value L of brightness, and for a zone with a value of brightness larger than the first value L of brightness, the first value L of brightness is assigned to the zone, so the revised values of brightness after compensation can be derived as depicted in Table 17.

TABLE 17

| | | |
|---|---|---|
| 80 | 81.34 | 93.5 |
| 82.8 | 82 | 84.6 |
| 74.8 | 83.7 | 81.7 |

In connection with both Table 9 and Table 17, the second table of compensation tables after revision can be derived inversely as the first table of revised compensation tables as depicted in Table 18.

TABLE 18

| | | |
|---|---|---|
| 1 | 0.98 | 0.954 |
| 0.92 | 0.82 | 0.9 |
| 0.88 | 0.9 | 0.86 |

Then the second table of revised compensation tables depicted in Table 18 can be stored in the self-illuminating display device, and then the image displayed on the display screen of the self-illuminating display device can be compensated for according to the second table of revised compensation tables.

As can be apparent from comparison of Table 15 with Table 18, the compensation parameter of the zone F4 can be revised to thereby ensure the uniformity of brightness of the OLED display device not to be lower than the preset uniformity of brightness, so that the image displayed on the display screen can be compensated for according to the second table of revised compensation tables to thereby lower the difference in degradation of the self-illuminating elements in the respective zones as much as possible while ensuring the uniformity of brightness.

Furthermore the brightness of the image displayed in each of the N zones can be compensated for according to the table of compensation parameters by retrieving the compensation parameter of each of the N zones from the first table of revised compensation parameters of the self-illuminating display device and then compensating for the gate drive voltages of all of the self-illuminating elements in each zone of the image displayed on the display screen of the self-illuminating display device according to the compensation parameter of each zone; or by retrieving the compensation parameter of each of the N zones from the second table of revised compensation parameters of the self-illuminating display device and then compensating for the gate drive voltages of all of the self-illuminating elements in each zone of the image displayed on the display screen of the self-illuminating display device or the grayscales of all of the self-illuminating elements in each zone according to the compensation parameter of each zone.

It shall be noted that since the brightness at a self-illuminating element is in proportion to the grayscale thereof and also to current flowing through the self-illuminating element in a particular relationship as represented in Equation below (3) of:

$$I_{ds} = \frac{1}{2}uC_{ox}\frac{W}{L}(Vgs - Vth)^2 = \frac{1}{2}uC_{ox}\frac{W}{L}(Vg - Vs - Vth)^2 \quad (3)$$

Where u represents the mobility of a drive Thin Film Transistor (TFT), $C_{ox}$ represents the capacitance of a gate insulation layer of the drive TFT, W and L represent the width and the length of the drive TFT, Vg represents the gate voltage of the drive TFT, Vs represents the source voltage of the drive TFT, and Vth represents the threshold voltage of the drive TFT.

As can be apparent from Equation (3), when the gate voltage Vg of the drive TFT of the self-illuminating element is higher, the current $I_{ds}$ flowing through the self-illuminating element will be larger, and further the brightness at the self-illuminating element will be higher; and when the gate voltage Vg of the drive TFT of the self-illuminating element is lower, the current $I_{ds}$ flowing through the self-illuminating element will be smaller, and further the brightness at the self-illuminating element will be lower, so the brightness at the self-illuminating element can be changed by charging the gate voltage Vg of the drive TFT of the self-illuminating element.

In an embodiment of the application, firstly the compensation parameter of each of the N zones is retrieved from the first table of compensation parameters of the self-illuminating display device, and then the gate drive voltages of all of the self-illuminating elements in each zone of the image displayed on the display screen of the self-illuminating display device are compensated for according to the compensation parameter of each zone; or the compensation parameter of each of the N zones is retrieved from the second table of compensation parameters of the self-illuminating display device, and then the gate drive voltages of all of the self-illuminating elements in each zone of the image displayed on the display screen of the self-illuminating display device or the grayscales of all of the self-illuminating elements in each zone are compensated for according to the compensation parameter of each zone.

The brightness of the image displayed on the display screen of the self-illuminating display device can be compensated for according to the first table of revised compensation parameters by multiplying the gate drive voltage of each self-illuminating element in the image with the compensation parameter of the zone where the self-illuminating element is located to thereby compensate for the brightness at each self-illuminating element in the image. Each compensation parameter of the first table of revised compensation parameters can be larger than or equal to 1 to thereby raise or maintain the level of brightness at each self-illuminating element in the image after compensation.

The brightness of the image displayed on the display screen of the self-illuminating display device can be compensated for according to the second table of revised compensation parameters by multiplying the gate drive voltage of each self-illuminating element in the image with the compensation parameter of the zone where the self-illuminating element is located to thereby compensate for the brightness at each self-illuminating element in the image or by multiplying the grayscale of each self-illuminating element in the image with the compensation parameter of the zone where the self-illuminating element is located to thereby compensate for the brightness at each self-illuminating element in the image. Each compensation parameter of the second table of revised compensation parameters can be smaller than or equal to 1 to thereby lower or maintain the level of brightness at each self-illuminating element in the image after compensation.

The embodiment of the application provides a brightness compensating method applicable to a self-illuminating display device, where a display screen of the self-illuminating display device is divided into N zones by their temperature gradients in stabilized operation, and the N zones include a reference zone with a compensation parameter G. The brightness compensating method includes: firstly retrieving a table of compensation parameters pre-stored in the self-illuminating display device, which includes compensation parameters of the N zones, where a compensation parameter of a zone at higher temperature than the temperature in the reference zone is smaller than G, and a compensation parameter of a zone at lower temperature than the temperature in the reference zone is larger than G; and then compensating for the brightness in an image displayed in each of the N zones according to the table of compensation parameters.

Figure 3:
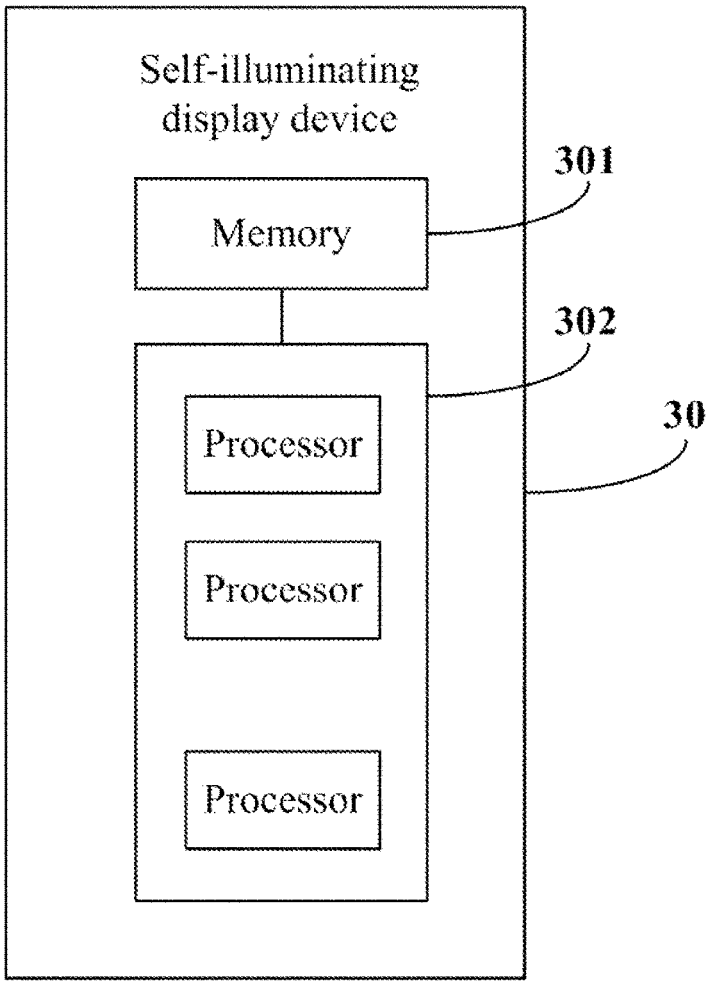
FIG. 3 is a schematic structural diagram of a self-illuminating display device according to an embodiment of the application.

An embodiment of the application further provides a self-illuminating display device 30 as illustrated in FIG. 3, where a display screen of the self-illuminating display device is divided into N zones by their temperature gradients when the display screen is in stabilized operation, the N zones include a reference zone with a compensation parameter G, N is an integer larger than or equal to 2, and G is larger than 0; and the self-illuminating display device 30 includes a memory 301 and one or more processors 302, where the memory stores one or more computer readable program codes, and the one or more processors are configured to execute the one or more computer readable program codes to perform:

A table of compensation parameters pre-stored in the self-illuminating display device 30 is retrieved, which includes compensation parameters of the N zones, where a compensation parameter of a zone at higher temperature than the temperature in the reference zone is smaller than G, and a compensation parameter of a zone at lower temperature than the temperature in the reference zone is larger than G.

Upon initialization, the table of compensation parameters is pre-stored in the self-illuminating display device 30, and the table of compensation parameters includes compensation parameters of the N zones, that is, the table of compensation parameters includes N compensation parameters, each of which corresponds to one of the zones. By way of an example, the table of compensation parameters can be stored in a control circuit of the self-illuminating display device 30 or can be stored in a memory of the self-illuminating display device 30, and when an image is displayed on the display screen of self-illuminating display device 30, need only retrieve the pre-stored table of compensation parameters will be retrieved simply from the memory firstly.

The brightness in an image displayed in each of the N zones is compensated for according to the table of compensation parameters.

The image displayed on the display screen of the self-illuminating display device 30 can be compensated for by compensating for the grayscale of each self-illuminating element in the display screen of the self-illuminating display device 30 to compensate for the brightness of the image or by compensating for the gate drive voltage of each self-illuminating element to compensate for the brightness of the image. It shall be noted that in the way where the brightness of the image is compensated for by compensating for the grayscale of each self-illuminating element, the grayscale can not become higher when the highest grayscale is displayed on the display screen, so the brightness at the self-illuminating element can not be raised by increasing the value of grayscale of the self-illuminating element, but generally the value of grayscale of the self-illuminating element can only be decreased to thereby lower the brightness of the image. In the way where the brightness of the image is compensated for by increasing the value of gate drive voltage of each self-illuminating element, the brightness of the image can be raised by increasing the value of drive voltage of the self-illuminating element of the image, and also the brightness of the image can be lowered by decreasing the value of drive voltage of the self-illuminating element of the image.

As such, when the brightness is compensated for, a compensating module of the self-illuminating display device compensates for the brightness of the image displayed in each of the N zones according to the retrieved table of compensation parameters, retrieved by a first retrieving module, in which different compensation parameters are set for different zones according to a temperature profile throughout the different zones of the display screen in operation so that there is lower brightness in a zone at higher temperature in the self-illuminating display device and there is higher brightness in a zone at lower temperature in the self-illuminating display device to thereby lower the rate, at which self-illuminating elements in the zone at higher operating temperature are degraded, by lowering the brightness in the zone at higher operating temperature, and also improve the rate, at which self-illuminating elements in the zone at lower operating temperature are degraded, by raising the brightness in the zone at lower operating temperature, so that there is a smaller difference between the rate at which the self-illuminating elements in the zone at higher operating temperature are degraded and the rate at which the self-illuminating elements in the zone at lower operating temperature are degraded, thereby lowering the difference between the illumination brightness in the self-illuminating elements in the zone at higher operating temperature and the illumination brightness in the self-illuminating elements in the zone at lower operating temperature after operating for a long period of time so as to avoid the phenomenon of blocky mura occurring in the display screen of the self-illuminating display device after operating for a long period of time.

In an embodiment of the application, the table of compensation parameters is a first table of compensation parameters or a second table of compensation parameters.

When the table of compensation parameters is the first table of compensation parameters, one of the N zones at the highest temperature is the reference zone, and the compensation parameter of the zone at the highest temperature in the first table of compensation parameters is G, all of the compensation parameters of the other N−1 zones are larger than G, and the largest one of the N compensation parameters is smaller than or equal to A which is the ratio of the value of brightness in the brightest one to the value of brightness in the darkest one of the N zones when a fully white image is displayed by the self-illuminating display device; and when the table of compensation parameters is the second table of compensation parameters, one of the N zones at the lowest temperature is the reference zone, and the compensation parameter of the zone at the lowest temperature in the second table of compensation parameters is G, all of the compensation parameters of the other N−1 zones is smaller than G, and the smallest one of the N compensation parameters is larger than or equal to B which is the ratio of the value of brightness in the darkest one to the value of brightness in the brightest one of the N zones when a fully white image is displayed by the self-illuminating display device.

In an embodiment of the application, before the compensation parameters of the self-illuminating display device are retrieved, the one or more processors 302 are further configured to execute the one or more computer readable program codes:

To obtain the original brightness in each of the N zones when the all-white image is input to the self-illuminating display device 30;

To derive A from the value of brightness in each of the N zones; or to derive B from the value of brightness in each of the N zones;

To obtain the temperature in each of the N zones after the self-illuminating display device has operated for a preset period of time;

To create the first table of compensation parameters from the temperature in each of the N zones, G and A; and to create the second table of compensation parameters from the temperature in each of the N zones, G and B; and To store the first table of compensation parameters or the second table of compensation parameters.

In an embodiment of the application, when the compensation parameter of the zone at the highest temperature is G, creating the first table of compensation parameters from the temperature in each of the N zones, G and A includes the following operations:

The compensation parameter $k_i$ of the i-th zone among the other N−1 zones is derived in Equation (1) of $$k_i = G + \frac{D_i|G - A|}{S},$$

where $D_i$ represents the difference in temperature between the i-th zone and the zone at the highest temperature, S represents the rise in temperature of the zone at the highest temperature, $1 \le i \le (N-1)$, and the rise in temperature of the zone at the highest temperature is the difference between the temperature in the zone at the highest temperature after operating for the preset period of time and the temperature thereof before being started into operation; and The first table of compensation parameters is created from the compensation parameter G of the zone at the highest temperature and the compensation parameters of the other N−1 zones.

In an embodiment of the application, when the compensation parameter of the zone at the highest temperature is G, creating the second table of compensation parameters from the temperature in each of the N zones, G and B includes the following operations:

The compensation parameter $k_i$ of the i-th zone among the other N−1 zones is derived in Equation (2) of $$k_i = G - \frac{D_i|G - B|}{S},$$

where $D_i$ represents the difference in temperature between the i-th zone and the zone at the lowest temperature, S represents the rise in temperature of the zone at the highest temperature, $1 \le i \le (N-1)$, and the rise in temperature of the zone at the highest temperature is the difference between the temperature in the zone at the highest temperature after operating for the preset period of time and the temperature thereof before being started into operation; and The second table of compensation parameters is created from the compensation parameter G of the zone at the lowest temperature and the compensation parameters of the other N−1 zones.

Furthermore after the first table of compensation parameters is created from the temperature in each of the N zones, G and A or the second table of compensation parameters is created from the temperature in each of the N zones, G and B, the one or more processors 302 are further configured to execute the one or more computer readable program codes:

To compensate for the all-white image according to the first table of compensation parameters or the second table of compensation parameters;

To obtain the brightness after compensation in each of the N zones after compensation;

To derive the uniformity of brightness of the self-illuminating display device 30 after compensation from the brightness after compensation in each of the N zones;

If the uniformity of brightness of the display screen after compensation is lower than preset uniformity of brightness, to revise the compensation parameters, in the first table of compensation parameters, corresponding to the respective zones with values of brightness larger than a first value of brightness among the N zones after compensation as a function of the preset uniformity of brightness and the value of brightness in the darkest one of the N zones after compensation to create a first table of revised compensation parameters, or to revise the compensation parameters, in the second table of compensation parameters, corresponding to the respective zones with values of brightness larger than a second value of brightness among the N zones after compensation as function thereof to create a second table of revised compensation parameters, where the first value of brightness is the ratio of the value of brightness in the darkest one of the N zones to the preset uniformity of brightness; and To store the first table of revised compensation parameters or the second table of revised compensation parameters.

In an embodiment of the application, compensating for the brightness of the image displayed in each of the N zones according to the table of compensation parameters includes the following operations:

The compensation parameter of each of the N zones is retrieved from the first table of revised compensation parameters, and the gate drive voltages of all of the self-illuminating elements in each zone of the image displayed on the self-illuminating display device 30 are compensated for according to the compensation parameter of each zone; or the compensation parameter of each of the N zones is retrieved from the second table of revised compensation parameters, and the gate drive voltages of all of the self-illuminating elements in each zone of the image displayed on the self-illuminating display device 30 or the grayscales of all of the self-illuminating elements in each zone are compensated for according to the compensation parameter of each zone.

The embodiment of the application provides a self-illuminating display device, where a display screen of the self-illuminating display device is divided into N zones by their temperature gradients when the display screen is in stabilized operation, and the N zones include a reference zone with a compensation parameter G. When the self-illuminating display device compensates for brightness, firstly the first retrieving modules retrieves a table of compensation parameters pre-stored in the self-illuminating display device, which includes compensation parameters of the N zones, where a compensation parameter of a zone at higher temperature than the temperature in the reference zone is smaller than G, and a compensation parameter of a zone at lower temperature than the temperature in the reference zone is larger than G; and then the compensating module compensates for the brightness in an image displayed in each of the N zones according to the table of compensation parameters.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A brightness compensating method applicable to a self-illuminating display device, wherein a display screen of the self-illuminating display device has N zones including a reference zone with a compensation parameter G, and N is an integer larger than or equal to 2, and the G is larger than 0; and the method comprises:

retrieving compensation parameters of at least a part of the N zones, wherein a change trend of a compensation parameter of a zone at higher temperature than temperature in the reference zone relative to the compensation parameter G is opposite to a change trend of a compensation parameter of a zone at lower temperature than temperature in the reference zone relative to the compensation parameter G; and compensating for brightness of an image displayed in the respective zones according to the compensation parameters;

wherein when the reference zone is the zone at a highest temperature of the N zones, G is a compensation parameter of said zone at the highest temperature, all N−1 compensation parameters of the other N−1 zones are larger than G, and a largest one of N compensation parameters of the N zones is smaller than or equal to A, where A is a ratio of a value of brightness in a brightest one of the N zones to a value of brightness in a darkest one of the N zones when a fully white image is displayed by the self-illuminating display device; and wherein when the reference zone is the zone at a lowest temperature of the N zones, G is a compensation parameter of said zone at the lowest temperature, all compensation parameters of the other N−1 zones are smaller than G, and a smallest one of N compensation parameters of the N zones is larger than or equal to B, where B is a ratio of a value of brightness in a darkest one of the N zones to a value of brightness in a brightest one of the N zones when a fully white image is displayed by the self-illuminating display device.

2. The method of claim 1, wherein before the compensation parameters of the self-illuminating display device are retrieved, the method further comprises:

obtaining a value of brightness in each of the N zones when the all-white image is input to a display screen of the self-illuminating display device;

deriving A from the value of brightness in each of the N zones; or deriving B from the value of brightness in each of the N zones;

obtaining temperature in each of the N zones after the self-illuminating display device has operated for a preset period of time;

retrieving the compensation parameters from the temperature in each of the N zones, G and A; and retrieving the compensation parameters from the temperature in each of the N zones, G and B; and storing the compensation parameters.

3. The method of claim 2, wherein the compensation parameter of the zone at the highest temperature is G; and the retrieving the compensation parameters from the temperature in each of the N zones, G and A comprises:

deriving a compensation parameter $k_i$ of a i-th zone among other N−1 zones in Equation (1) of $$k_i = G + \frac{D_i|G - A|}{S},$$

wherein $D_i$ represents a difference in temperature between the i-th zone and the zone at the highest temperature, S represents a rise in temperature of the zone at the highest temperature, $1 \le i \le (N-1)$, and the rise in temperature of the zone at the highest temperature is the difference between the temperature in the zone at the highest temperature after operating for the preset period of time and the temperature in the zone at the highest temperature before being started into operation; or the compensation parameter of the zone at the lowest temperature is G; and the creating the compensation parameters from the temperature in each of the N zones, G and B comprises:

deriving a compensation parameter $k_i$ of a i-th zone among other N−1 zones in Equation (2) of $$k_i = G - \frac{D_1|G - B|}{S},$$

wherein $D_i$ represents a difference in temperature between the i-th zone and the zone at the lowest temperature, S represents a rise in temperature of the zone at the highest temperature, $1 \le i \le (N-1)$, and the rise in temperature of the zone at the highest temperature is the difference between the temperature in the zone at the highest temperature after operating for the preset period of time and the temperature in the zone at the highest temperature before being started into operation.

4. The method of claim 3, wherein after the compensation parameters are retrieved from the temperature in each of the N zones, G and A or the compensation parameters are retrieved from the temperature in each of the N zones, G and B, the method further comprises:

compensating for the all-white image according to the compensation parameters;

obtaining the brightness after compensation in each of the N zones after compensation;

deriving uniformity of brightness of the display screen after compensation from the brightness after compensation in each of the N zones;

if the uniformity of brightness of the display screen after compensation is lower than preset uniformity of brightness, then revising the compensation parameters corresponding to the respective zones with values of brightness larger than a first value of brightness among the N zones after compensation as a function of the preset uniformity of brightness and the value of brightness in the darkest one of the N zones after compensation to create first revised compensation parameters; or revising the compensation parameters corresponding to the respective zones with values of brightness larger than a second value of brightness among the N zones after compensation as function of the preset uniformity of brightness and the value of brightness in the darkest one of the N zones after compensation to create second revised compensation parameters, wherein the first value of brightness is a ratio of the value of brightness in the darkest one of the N zones to the preset uniformity of brightness; and storing the first revised compensation parameters or the second revised compensation parameters.

5. The method of claim 4, wherein the compensating for the brightness of the image displayed in each of the N zones according to the compensation parameters comprises:

retrieving a compensation parameter of each of the N zones from the first revised compensation parameters;

compensating for gate drive voltages of all of self-illuminating elements in each zone of the image displayed on the display screen of the self-illuminating display device according to the compensation parameter of each zone; or retrieving the compensation parameter of each of the N zones from the second revised compensation parameters; and compensating for gate drive voltages of all of self-illuminating elements in each zone of the image displayed on the self-illuminating display device or gray-scales of all of the self-illuminating elements in each zone according to the compensation parameter of each zone.

6. A self-illuminating display device, wherein a display screen of the self-illuminating display device has N zones including a reference zone with a compensation parameter G, N is an integer larger than or equal to 2, and G is larger than 0; and the self-illuminating display device comprises a memory and one or more processors, and wherein the memory stores one or more computer readable program codes, and the one or more processors are configured to execute the one or more computer readable program codes to perform:

retrieving compensation parameters of at least a part of the N zones, wherein a change trend of a compensation parameter of a zone at higher temperature than temperature in the reference zone relative to the compensation parameter G is opposite to a change trend of a compensation parameter of a zone at lower temperature than temperature in the reference zone relative to the compensation parameter G; and compensating for brightness of an image displayed in the respective zones according to the compensation parameters;

wherein when the reference zone is the zone at a highest temperature of the N zones, G is a compensation parameter of said zone at the highest temperature, all N−1 compensation parameters of the other N−1 zones are larger than G, and a largest one of N compensation parameters of the N zones is smaller than or equal to A, where A is a ratio of a value of brightness in a brightest one of the N zones to a value of brightness in a darkest one of the N zones when a fully white image is displayed by the self-illuminating display device; and wherein when the reference zone is the zone at a lowest temperature of the N zones, G is a compensation parameter of said zone at the lowest temperature, all compensation parameters of the other N−1 zones are smaller than G, and a smallest one of N compensation parameters of the N zones is larger than or equal to B, where B is a ratio of a value of brightness in a darkest one of the N zones to a value of brightness in a brightest one of the N zones when a fully white image is displayed by the self-illuminating display device.

7. The self-illuminating display device of claim 6, wherein before the compensation parameters of the self-illuminating display device are retrieved, the one or more processors are further configured to execute the one or more computer readable program codes to perform:

obtaining a value of brightness in each of the N zones when the all-white image is input to a display screen of the self-illuminating display device;

deriving A from the value of brightness in each of the N zones; or deriving B from the value of brightness in each of the N zones;

obtaining temperature in each of the N zones after the self-illuminating display device has operated for a preset period of time;

retrieving the compensation parameters from the temperature in each of the N zones, G and A; and retrieving the compensation parameters from the temperature in each of the N zones, G and B; and storing the compensation parameters.

8. The self-illuminating display device of claim 7, wherein the compensation parameter of the zone at the highest temperature is G; and the retrieving the compensation parameters from the temperature in each of the N zones, G and A comprises:

deriving a compensation parameter $k_i$ of a i-th zone among other N−1 zones in Equation (1) of $$k_i = G + \frac{D_i|G - A|}{S},$$

wherein $D_i$ represents a difference in temperature between the i-th zone and the zone at the highest temperature, S represents a rise in temperature of the zone at the highest temperature, $1 \le i \le (N-1)$, and the rise in temperature of the zone at the highest temperature is the difference between the temperature in the zone at the highest temperature after operating for the preset period of time and the temperature in the zone at the highest temperature before being started into operation; or the compensation parameter of the zone at the lowest temperature is G; and the creating the compensation parameters from the temperature in each of the N zones, G and B comprises:

deriving a compensation parameter $k_i$ of a i-th zone among other N−1 zones in Equation (2) of $$k_i = G - \frac{D_i|G - B|}{S},$$

wherein $D_i$ represents a difference in temperature between the i-th zone and the zone at the lowest temperature, S represents a rise in temperature of the zone at the highest temperature, $1 \leq i \leq (N-1)$, and the rise in temperature of the zone at the highest temperature is the difference between the temperature in the zone at the highest temperature after operating for the preset period of time and the temperature in the zone at the highest temperature before being started into operation.

9. The self-illuminating display device of claim 8, wherein after the compensation parameters are retrieved from the temperature in each of the N zones, G and A or the compensation parameters are retrieved from the temperature in each of the N zones, G and B, the one or more processors are further configured to execute the one or more computer readable program codes to perform:

compensating for the all-white image according to the compensation parameters;

obtaining the brightness after compensation in each of the N zones after compensation;

deriving uniformity of brightness of the display screen after compensation from the brightness after compensation in each of the N zones;

if the uniformity of brightness of the display screen after compensation is lower than preset uniformity of brightness, then revising the compensation parameters corresponding to the respective zones with values of brightness larger than a first value of brightness among the N zones after compensation as a function of the preset uniformity of brightness and the value of brightness in the darkest one of the N zones after compensation to create first revised compensation parameters; or revising the compensation parameters corresponding to the respective zones with values of brightness larger than a second value of brightness among the N zones after compensation as function of the preset uniformity of brightness and the value of brightness in the darkest one of the N zones after compensation to create second revised compensation parameters, wherein the first value of brightness is a ratio of the value of brightness in the darkest one of the N zones to the preset uniformity of brightness; and storing the first revised compensation parameters or the second revised compensation parameters.

10. The self-illuminating display device of claim 9, wherein the compensating for the brightness of the image displayed in each of the N zones according to the compensation parameters comprises:

retrieving a compensation parameter of each of the N zones from the first revised compensation parameters;

compensating for gate drive voltages of all of self-illuminating elements in each zone of the image displayed on the display screen of the self-illuminating display device according to the compensation parameter of each zone; or retrieving the compensation parameter of each of the N zones from the second revised compensation parameters; and compensating for gate drive voltages of all of self-illuminating elements in each zone of the image displayed on the self-illuminating display device or grayscales of all of the self-illuminating elements in each zone according to the compensation parameter of each zone.

* * * * *